US005686149A

United States Patent [19]

Buhlmann

[11] Patent Number: 5,686,149

[45] Date of Patent: Nov. 11, 1997

[54] SPRAY DEVICE AND METHOD FOR POWDER COATING MATERIAL

[75] Inventor: Eugen Thomas Buhlmann, Gossau, Switzerland

[73] Assignee: GEMA Volstatic AG, Gallen, Switzerland

[21] Appl. No.: 582,709

[22] Filed: Jan. 4, 1996

[30] Foreign Application Priority Data

Jan. 27, 1995 [DE] Germany ..... 195 02 522.9

[51] Int. Cl.[6] ..... B05D 1/04; B05D 1/06; B05B 5/025

[52] U.S. Cl. ..... 427/475; 427/485; 118/626; 118/627; 118/629

[58] Field of Search ..... 427/475, 476, 427/483, 485; 239/697, 705–708; 118/626, 627, 629

[56] References Cited

U.S. PATENT DOCUMENTS

| | | | |
|---|---|---|---|
| 3,344,992 | 10/1967 | Norris | 239/8 |
| 3,747,852 | 7/1973 | Nord et al. | 239/483 |
| 3,952,951 | 4/1976 | Raetz et al. | 239/705 |
| 4,574,092 | 3/1986 | Gourdine | 427/483 |
| 4,735,360 | 4/1988 | Kirchner et al. | 239/3 |

FOREIGN PATENT DOCUMENTS

| | | |
|---|---|---|
| 107499 | 5/1984 | European Pat. Off. . |
| 2446022 | 4/1976 | Germany . |
| 2601434 | 7/1976 | Germany . |
| 3119441 | 4/1982 | Germany . |
| 3608415 | 9/1987 | Germany . |
| 3812358 | 10/1989 | Germany . |

*Primary Examiner*—Michael Lusignan
*Assistant Examiner*—Fred J. Parker
*Attorney, Agent, or Firm*—MacMillan, Sobanski & Todd

[57] ABSTRACT

A spray device and method for the coating of objects with powder coating material. A high voltage electrode or several electrodes are located on only one side of the coating material stream in the vicinity of a spray orifice for electrostatically charging the coating material. A first flow of compressed air is directed over the electrodes to keep the coating material from accumulating on the electrode and to shape the envelope of the sprayed coating material. A second stream of compressed air is directed at the stream of coating material to counteract the deflection of the stream by the first flow and by the effects of the high voltage. Better coating efficiency (reduced loss of sprayed powder) is achieved than with electrodes arranged on both sides of the coating material stream.

15 Claims, 2 Drawing Sheets

SPRAY DEVICE AND METHOD FOR POWDER COATING MATERIAL

TECHNICAL FIELD

The invention relates to a spray device for coating material and more specifically to a spray device for discharging and electrostatically charging powder coating materials for spray coating objects.

BACKGROUND ART

Powder coating materials are commonly applied by imparting an electrostatic charge to the coating relative to the workpiece being coated. The charge draws the powder to the surfaces of the workpiece and tends to hold the powder particles on the surfaces until they can be fused to the surface. An electrostatic charge is imparted to the powder through direct or indirect contact with one or more electrodes which are charged to a high voltage. Commonly, the high voltage is within the range of from at least 10,000 volts to 100,000 volts or more. The higher voltages tend to provide for increased efficiencies in transferring the sprayed powder to the workpiece surfaces.

For electrostatic coating with powder materials, the prior art shows an electrostatic spray device with a cross-sectional round spray nozzle opening and with one high-voltage electrode in two compressed air discharge openings which converge on each other in the powder flow direction. The prior art also describes a flat jet nozzle for coating powders which requires at least one high-voltage electrode for electrical charging of the coating powder. When two high-voltage electrodes are used, they are arranged diametrically opposed on both sides of the powder stream in compressed air discharge openings in an outer nozzle end face pointing downstream in the flow direction of the discharged powder.

The prior art also shows a spray device for the spray-coating of objects with coating powder which features a powder duct whose cross section is, at the downstream end, conically reduced to the diameter of a spray orifice. The orifice has the shape of a slot for producing a flat pattern to the spray. The center axis of the spray orifice is aligned on the center axis of the powder duct. A tubular electrode holder is contained axially in the powder duct. The electrode holder is attached to the wall of the powder duct by way of crosswise or radial stays. A compressed air duct extends axially through the electrode holder. A high-voltage electrode is arranged in the downstream end of the duct for electrically charging the coating powder. The electrode is swept by the compressed air. The compressed air serves to keep the powder particles away from the electrode and to transfer electrical charges from the electrode to the coating powder. This prior art spray device has a good coating efficiency and produces good coating qualities. But sometimes a risk exists that powder may accumulate on the stays of the electrode holder and that such powder accumulations may from time to time break lose and be sprayed on the object being coated, resulting in small appearance defects in the coating. The electrode arranged in the center of the powder stream and the compressed air flow sweeping it, as well as the electrode holder and its supports, also sometimes cause a splitting of the sprayed powder stream into finger type or leaf-shaped partial jets.

The prior art further teaches a spray device for the electrostatic spray-coating of objects with liquid coating material in which a spray nozzle has two compressed air duct openings, each with a high-voltage electrode arranged therein. The two compressed air duct openings are arranged downstream of the spray orifice and, relative to the spray orifice's center axis, diametrically opposed at the edge of the atomized coating material stream. The electrodes protrude a short distance out of the compressed air duct openings. The electrodes serve to electrostatically charge the sprayed liquid coating material. The compressed air stream sweeping the electrodes has two purposes, namely to reshape the initially cylindrical stream of atomized coating material into a flat or fan shaped jet and to keep coating material off the electrodes. This type of spray device is available only for liquid coating material and not for coating powder.

DISCLOSURE OF INVENTION

According to the invention, a powder coating material spray gun is provided with a nozzle having a material channel terminating at an end having a material spray orifice. Preferably, the spray orifice is shaped to impart a flat fan shape to the discharged coating material. One or more high voltage electrodes are arranged in or adjacent one side of the spray orifice for imparting an electrostatic charge to the stream of coating material. A first stream of compressed air flows over the electrodes to prevent powder buildup on the electrode. The first stream compressed air is directed at one side of the flow path of the stream of coating material. The stream of coating material tends to be deflected by both the high voltage and the first stream of compressed air. A second stream of compressed air which does not contact any high voltage electrode is directed at the stream of coating material diametrically opposite the first stream to counterbalance the deflection effects of the first air stream and the high voltage. The first and second streams of compressed air may have sufficient velocity to impart, in cross section, a flat fan shape to the sprayed stream of coating material.

In conjunction with the invention it was surprisingly found that not only are powder deposits upstream of the spray nozzle which can occur with a coaxial high voltage electrode avoided, but that at the same time a better coating powder transfer efficiency (reduced loss of sprayed powder) is achieved when arranging a high-voltage electrode on only one side of the coating material stream. Instead of a single electrode, a group of electrodes can be arranged on only one side of the coating material stream, but a mutually unfavorable influencing may occur in the use of several electrodes. For that reason, the preferred embodiment of the invention comprises the use of only a single electrode. In tests conducted with only a single electrode arranged on only one side of the powder stream it was possible to achieve with coating powder an improvement of efficiency up to nearly 10%, namely, nearly 10% more sprayed coating powder reached and adhered to the object being coated.

Accordingly, it is an object of the invention to provide a spray gun nozzle for spraying electrostatically charged powder coating material.

Other objects and advantages of the invention will become apparent from the following detailed description of the invention and the accompanying drawings.

BEST MODE FOR CARRYING OUT THE INVENTION

Figure 1:
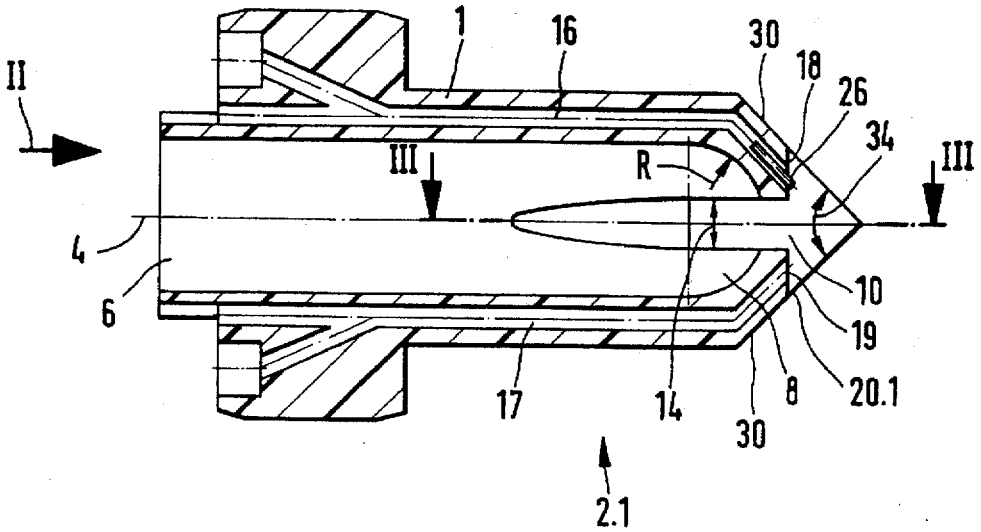
FIG. 1 is a longitudinal cross sectional view through a spray nozzle of a spray device according to the invention for the spray coating of objects with coating powder.

The various embodiments of spray nozzle devices for the spray coating of objects with coating powder according to the invention as illustrated in FIGS. 1 through 9 are referenced 2.1, 2.4, 2.6 and 2.8, respectively, in FIGS. 1, 4, 6 and 8. All of the nozzle embodiments have a body 1, which preferably consists of plastic material. A material duct 6 for the coating powder extends axially through the body 1 in the direction of a center axis 4. A downstream end section 8 of the duct 6 is steadily reduced toward a slotted spray orifice 10. When viewed in longitudinal section, the end section 8 is preferably arcuate or spherical with a radius R. The slot-shaped spray orifice 10 is arranged symmetrically to the center axis 4. According to another embodiment (not shown), the spray orifice 10 is formed in a nozzle body of metal, ceramic or other material resistant to abrasion, which body either is fired in the nozzle body 1 or forms it. The spray orifice 10 may consist of a plurality of individual orifices.

Figure 3:
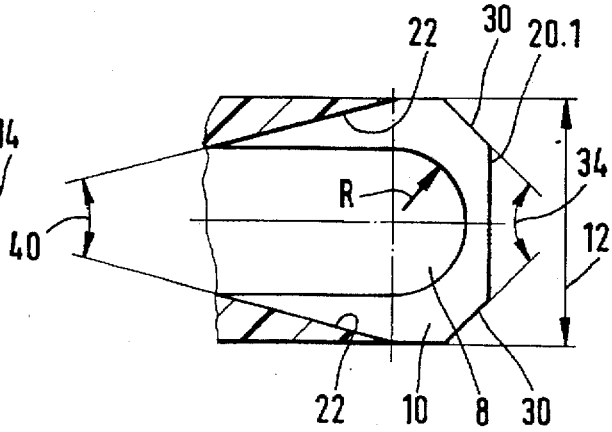
FIG. 3 is a fragmentary longitudinal cross sectional view as taken along line III—III of FIG. 1.

The slotted spray orifice 10 has in all embodiments a length 12 (as shown in FIG. 3) which is greater by a multiple than its width 14 (as shown in FIG. 1), as measured in directions perpendicular to each other and perpendicular to the center axis 4.

Figure 4:
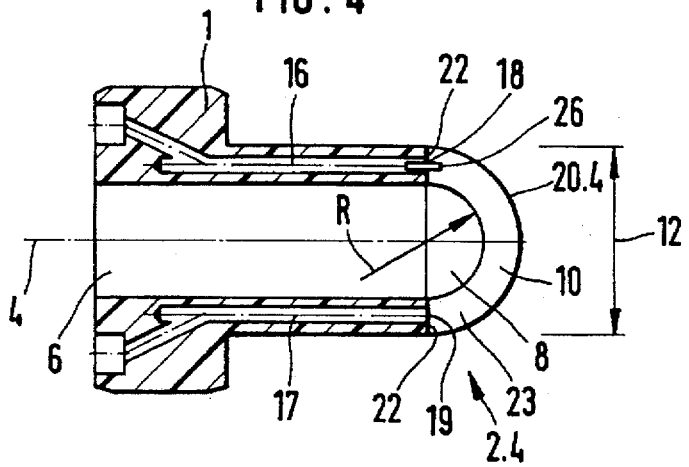
FIG. 4 is a longitudinal cross sectional view through a spray nozzle of a spray device according to a modified embodiment of the invention.
Figure 5:
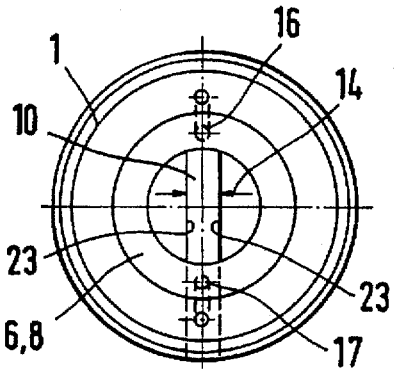
FIG. 5 is a rearward end view of the spray nozzle of FIG. 4.
Figure 6:
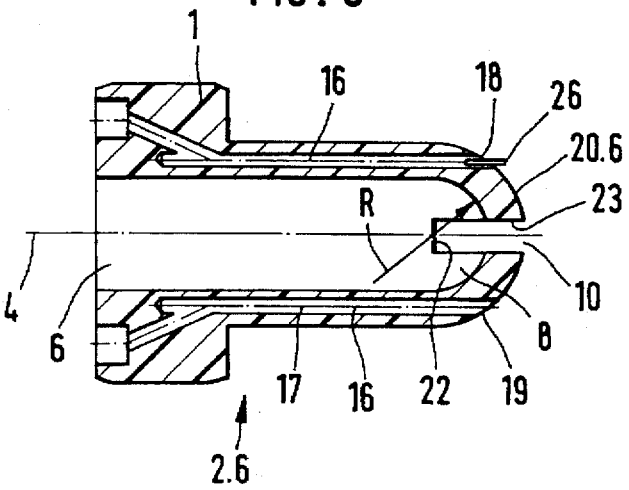
FIG. 6 is a longitudinal cross sectional view through a spray nozzle of a spray device according to a further modified embodiment of the invention.
Figure 7:
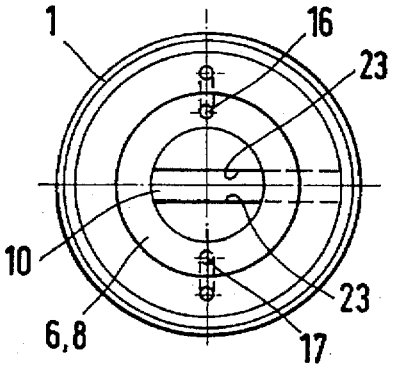
FIG. 7 is a rearward end view of the spray nozzle of FIG. 6.
Figure 8:
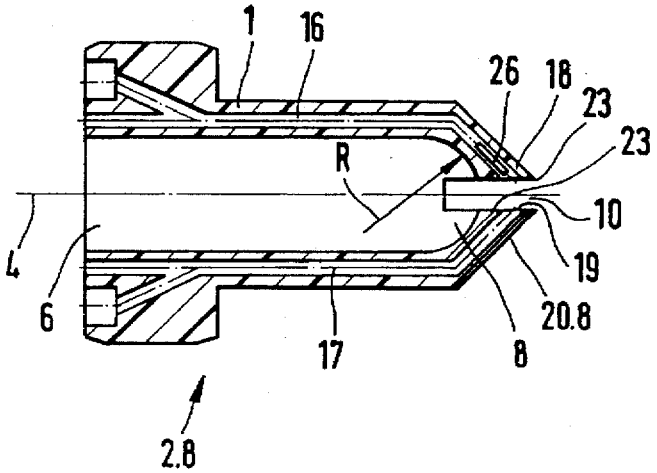
FIG. 8 is a longitudinal cross sectional view through a spray nozzle of a spray device according to still a further modified embodiment of the invention.
Figure 9:
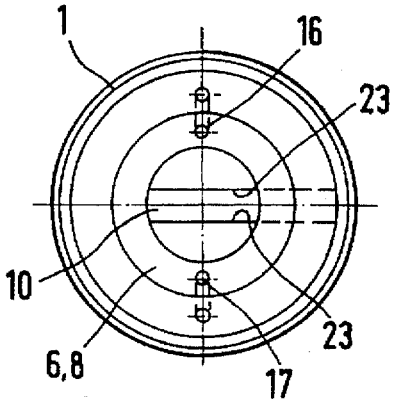
FIG. 9 is a rearward end view of the spray nozzle of FIG. 8.

All of the embodiments possess at least two compressed air ducts 16 and 17, having downstream duct openings 18 and 19 (opening edges) arranged diametrically with reference to the center axis 4, spaced from each other and spaced radially from the center axis 4. The duct openings 18 and 19 in FIG. 1 are contained in a downstream, outer end face 20.1. The outer end face 20.1 is flattened rectangularly in relation to the center axis 4. The spray orifice 10 is situated in the center of the end face 20.1 and the duct openings 18 and 19 are directly beside or only a few millimeters radially outside the spray orifice 10. In FIG. 4, the duct openings 18 and 19 are in two end faces 22 which, in relation to the flow direction of the powder stream of powder duct 6, point downstream: The end faces 22 each form a ring of the spray orifice 10 which is situated centrally in a semispherical downstream outer end face 20.4 and extending around its entire semicircular circumference. In FIG. 6, the duct openings 18 and 19 are contained in a semispherical rounded downstream outer end face 20.6. With reference to the center axis 4, the duct openings 18 and 19 are radially offset and, with reference to the longitudinal edges 23 of orifices 10, is sideways offset outside said spray orifice 10 which is formed centrally in said end face 20.6. In FIG. 8, the duct openings 18 and 19 are each contained in one of the two longitudinal edges of the spray orifice 10. In all of the embodiments, the crosswise edges 22 of the spray orifice 10 point downstream towards the axis 4 in powder flow direction, and the two longitudinal edges 23 oppose each other at parallel spacing. In the embodiment according to FIG. 8, the spray orifice 10 extends centrally and symmetrically through the tip of a truncated-cone-shaped outer end face 20.8.

In all of the embodiments, a high-voltage electrode 26 is arranged in only one of duct openings 18 and 19. The electrode 26 connects via an electric line (not shown), which extends through the compressed air duct 16 and connects to an electric high-voltage generator (not shown). A high-voltage ranging from 10,000 volts to 140,000 volts is applied to the electrode 26. The point or free end of the electrode 26 may be arranged within duct opening 18, in the plane of its opening rim, or a short upstream or downstream distant from it. Compressed air flows from a conventional compressed air supply (not shown) through both compressed air ducts 16 and 17, both through the one with the electrode 26 and through the one without the electrode 26, to the duct openings 18 and 19 and then is directed at the coating material stream from the material duct 6. The compressed air flow in the duct 16 carrying the electrode 26 prevents powder particles from clinging to the electrode 26 and also aids in charging the coating material. The compressed air flow in the duct 16 and the electron "wind" from the electrode 26 deflect the coating material stream somewhat. The compressed air discharging from the opening 19 of the other compressed air duct 17 counteracts said deflection of the coating material stream, preferably at a force that compensates completely for the deflection.

Figure 2:
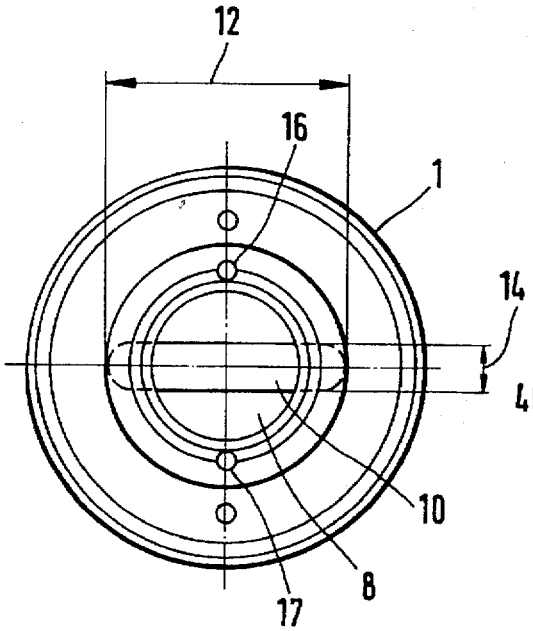
FIG. 2 is a rearward end view of the spray nozzle of FIG. 1 in the direction of arrow II.

In tests it has been demonstrated that the best efficiency (lowest loss of sprayed coating powder) and a very good coating quality (no splitting of the powder stream) is achieved when only a single electrode 26 is arranged on only one side of the coating material stream, in accordance with the illustrated embodiments of the invention. The most preferred embodiment is illustrated in FIGS. 1, 2 and 3 and has a flattened forward end face 20.1. Instead of one electrode 26, a group of electrodes 26 may be arranged to one side of the coating material stream. However, preference goes to a single electrode 26, since several electrodes 26 may affect one another in an electrostatically unfavorable manner.

In the embodiment according to FIGS. 1, 2 and 3, the electrode 26 lies radially outside the coating material stream immediately downstream from the spray orifice 10. The compressed air duct discharge openings 18 and 19 slant toward center axis 4 and in the flow direction of the coating material stream, so that the compressed air impinges on the atomized powder stream downstream from the spray orifice 10 and is deflected by the powder stream in its direction of flow. A front, annular surface 30 extending in truncated-cone fashion obliquely to the rear and outward borders radially outward on the flat end face 20.1. The arrangement of annular surface 30 is symmetric to the center axis 4 with a cone angle 34. The crosswise edges 22 of the spray orifice 10 extend according to the embodiments relative to FIGS. 4 through 9 perpendicularly to the center axis 4, while in the embodiment according to FIGS. 1 through 3 they diverge from each other in the flow direction of the coating material at angle 40 as shown in FIG. 3. The powder stream in the spray orifice 10 is thereby caused to expand symmetrically to the center axis 4.

The compressed air ducts 16 and 17 and their outlet openings 18 and 19 are preferably circular cylindrical bores. The body 1 has in all illustrated embodiments a circular shaped cross section. However, still other forms are possible. The body 1 may in all embodiments be mounted on a support body (not shown), such as a hand spray gun or a mechanically controlled spray gun, and preferably is exchangeable, through which support body the coating material and the electrode voltage are supplied. A coating powder is used as coating material in all of the embodiments.

It will be appreciated that various modifications and changes may be made to the above described preferred embodiment of a spray device and method for powder coating material without departing from the scope of the following claims.

I claim:

1. A spray device for spraying a stream of electrostatically charged powder coating material along a flow path comprising a nozzle having a coating material flow channel terminating at a spray orifice in a downstream end for discharging a stream of powder coating material, said flow channel and said spray orifice defining a portion of the coating material flow path, a high voltage electrode located to one side of the coating material flow path adjacent said spray orifice, means for applying a high voltage to said electrode, a first duct means for directing a first flow of air over said high voltage electrode and in a direction to impinge on one side of the stream of powder coating material adjacent said orifice, a second duct means for directing a second flow of air which is free of contact with high voltage in a direction to impinge on the stream of powder coating material adjacent said orifice on a side of the stream of powder coating material diametrically opposite the first flow of air, the second flow of air counteracting the deflection of the stream of powder coating material by the first flow of air and the deflection of the stream of powder coating material caused by the exposure of the first flow of air to the high voltage.

2. A spray device, as set forth in claim 1, and wherein said high voltage electrode comprises a plurality of high voltage electrodes located to said one side of the coating material flow path.

3. A spray device, as set forth in claim 1, and wherein said spray orifice has the shape era slit to impart a flat pattern to the stream of powder coating material discharged from said orifice.

4. A spray device, as set forth in claim 3, wherein said coating material flow channel has a cross sectional area and wherein said spray orifice has a cross sectional area which is smaller than said cross sectional area of said coating material flow channel.

5. A spray device, as set forth in claim 1, and wherein said nozzle has a body, and wherein said electrode is arranged in said nozzle body.

6. A spray device, as set forth in claim 5, and wherein said coating material flow channel has a central axis, wherein said nozzle body has a flat outer end face which extends at right angles to said axis, and wherein said spray orifice is located in said flat outer end face.

7. A spray device, as set forth in claim 6, and wherein said electrode is arranged in said flat outer end face.

8. A spray device, as set forth in claim 6, and wherein said means for directing the first and second air flows direct the first and second air flows to impinge on the stream of powder coating material while the stream of powder coating material is within said orifice and direct the air flows towards a downstream point on a center axis of said orifice.

9. A spray device, as set forth in claim 6, and wherein said downstream end of said coating material flow channel is spherical.

10. A spray device, as set forth in claim 1, and wherein said downstream end of said coating material flow channel is spherical.

11. A spray device, as set forth in claim 1, and wherein said means for directing the first and second air flows direct the first and second air flows to impinge on the stream of powder coating material while the stream of powder coating material is within said orifice and direct the air flows towards a downstream point on a center axis of said orifice.

12. A process for the spray coating of articles with electrostatically charged powder coating material comprising the steps of:

a) discharging a stream of powder coating material through an orifice of a spray nozzle;

b) applying a high voltage to an electrode located within the spray nozzle and adjacent one side of said stream of powder coating material to impart an electrostatic charge to the stream of powder coating material;

c) directing a first flow of air to flow over said high voltage electrode and to impinge against said one side of said stream of powder coating material; and d) directing a second flow of air which is free of contact with high voltage to impinge against said stream of powder coating material on a side diametrically opposite said one side of said stream of powder coating material to counteract deflection of said stream of powder coating material caused by the exposure to the high voltage and the impingement by said first flow of air.

13. A process for the spray coating of articles with powder coating material, as set forth in claim 12, and wherein said first and second flows of air impinge said stream of powder coating material within said orifice.

14. A process for the spray coating of articles with powder coating material, as set forth in claim 12, and wherein said first and second flows of air impinge said stream of powder coating material downstream from and adjacent to said orifice.

15. A process for the spray coating of articles with powder coating material, as set forth in claim 12, and wherein said orifice imparts a flat fan shape to the discharged stream of powder coating material.

* * * * *